US006241408B1

(12) United States Patent
Lang

(10) Patent No.: US 6,241,408 B1
(45) Date of Patent: Jun. 5, 2001

(54) DUAL PACK APPLICATIONS

(75) Inventor: Frank J. Lang, Warrenville, IL (US)

(73) Assignee: Federal Package Network, Inc., Chaska, MN (US)

( * ) Notice: Subject to any disclaimer, the term of this patent is extended or adjusted under 35 U.S.C. 154(b) by 0 days.

(21) Appl. No.: 09/293,790

(22) Filed: Apr. 20, 1999

(51) Int. Cl.[7] ..... B05C 1/00

(52) U.S. Cl. ..... 401/17; 401/19; 401/34; 132/297

(58) Field of Search ..... 401/17, 19, 21, 401/34, 20, 29, 31, 68, 69, 70, 71, 72, 73, 74, 75, 76, 77, 78, 79, 18; 132/297, 318

(56) References Cited

U.S. PATENT DOCUMENTS

| | | | | |
|---|---|---|---|---|
| 230,089 | | 7/1880 | Wallis . | |
| D. 267,822 | | 2/1983 | Katz et al. . | |
| D. 279,992 | | 8/1985 | Gribb . | |
| D. 321,717 | | 11/1991 | Hayes . | |
| D. 333,014 | | 2/1993 | Lang . | |
| D. 369,384 | | 4/1996 | Yasoshima . | |
| D. 370,088 | | 5/1996 | Burns . | |
| D. 389,066 | | 1/1998 | Lang . | |
| 1,508,090 | * | 9/1924 | Detrick | 401/17 |
| 2,177,651 | | 10/1939 | Harris . | |
| 2,196,127 | | 4/1940 | Stogran . | |
| 2,219,754 | | 10/1940 | Skold . | |
| 2,264,482 | | 12/1941 | Ridner, Sr. et al. . | |
| 2,298,620 | | 10/1942 | Harris . | |
| 2,695,028 | | 11/1954 | Dulberg . | |
| 2,710,614 | | 6/1955 | Dulberg . | |
| 2,902,041 | | 9/1959 | Bau . | |
| 2,964,045 | | 12/1960 | Otto et al. . | |
| 3,171,416 | | 3/1965 | Pimentel . | |
| 3,690,777 | | 9/1972 | Costa . | |
| 3,733,139 | * | 5/1973 | Neidhardt et al. | 401/17 |
| 5,373,940 | | 12/1994 | Hillelson . | |
| 5,509,742 | | 4/1996 | Balzarini . | |
| 5,655,554 | | 8/1997 | Goldberg . | |
| 5,842,802 | | 12/1998 | Lang et al. . | |
| 6,082,918 | * | 7/2000 | Gueret | 401/126 |

* cited by examiner

*Primary Examiner*—Steven O. Douglas
*Assistant Examiner*—Peter DeVore
(74) *Attorney, Agent, or Firm*—Breiner & Breiner

(57) ABSTRACT

Dual pack applicators capable of holding two separate volumes of product are described. The respective product volumes are separately accessible from opposite ends of the applicator. The applicator has an outer sleeve which holds two individual applicator assemblies. Each individual assembly has its own reservoir and dispensing mechanism and can be a pre-existing self-sufficient applicator. Each individual applicator assembly is secured within the sleeve by a friction fit or by a snap fit mechanism.

3 Claims, 2 Drawing Sheets

DUAL PACK APPLICATIONS

FIELD OF INVENTION

The present invention relates to hand-held stick applicators for dispensing a supply of material taking the form of a salve, semi-solid, gel, cream, liquid, or the like, to be applied by a rubbing contact with an application surface. The invention more particularly relates to dual pack applicators having an outer sleeve containing two separate volumes of material to be separately dispensed from opposite ends of the sleeve.

BACKGROUND OF THE INVENTION

Stick applicators having various dispensing structures are generally known as being useful for dispensing various products including lip balms, lipsticks, deodorants, and the like. Stick applicators may take the form of, for example, a roll-on applicator for a liquid or a screw-operated push-up applicator for a non-liquid substance.

In a typical screw operated push-up applicator, material is stored within a barrel and is supported by an internally threaded elevator. A rotatable dispensing screw extends longitudinally inside the barrel and engages the elevator. The screw has a control knob, located at a non-dispensing end of the barrel, that determines the elevator's position. When the knob is turned, the screw is rotated inside the barrel causing the elevator to travel longitudinally, and push the material out of an opposite (dispensing) end of the barrel.

In another embodiment of a screw-operated push-up applicator, the control knob is non-rotatably fixed within an outer container surrounding a barrel, such that upon turning the barrel itself by a collar on the opposite end has the effect of moving the elevator within the barrel. This structure is described in U.S. Pat. No. 5,842,802.

Known roll-on applicators have a rotatably suspended ball that carries a liquid material on the ball surface from a barrel interior to an exposed exterior.

Dual dispensing applicators have been proposed in the past. However, existing dual applicators are cumbersome and complex in structure and use. In some known devices, for example U.S. Pat. No. 3,690,777, the material to be dispensed is stored in removable closures instead of being held in the barrel itself. Removal of a closure from either end reveals an applicator tool used to remove and apply material stored inside the closure. Thus, the closure and applicator must each be maintained separately during use. Each closure serves both a reservoir function and a closure function. In another dual applicator device, as disclosed in U.S. Pat. No. 2,710,614, a duplex rotary holder has guide pins on carrier members that interact with rotating sleeves having helical slots. When one of the sleeves is turned, its respective slot pulls the guide pin causing the carrier to move longitudinally to dispense a solid material.

It would be desirable to have a dual applicator stick that integrates existing individual applicator assemblies in a dual pack configuration so that two separate product volumes are readily available to a user in a single package.

OBJECTS AND BRIEF DESCRIPTION OF THE INVENTION

A primary object of the present invention is to provide a versatile stick applicator for dual dispensing of separate volumes of stored product from opposite ends of the applicator.

Another object of the invention is to provide a dual applicator that economically integrates various existing single applicator assemblies in a dual pack configuration.

The dual pack applicators of the present invention include a generally tubular outer sleeve capable of receiving and holding two individual applicator assemblies, a dispensing end of each assembly being at one of the two open ends of the sleeve. The individual assemblies can be, for example, roll-on or screw-operated push-up applicators.

An individual barrel applicator assembly having a barrel with an outer diameter smaller than the inner diameter of the sleeve and having a length preferably approximately less than half that of the sleeve fits within the sleeve. The dispensing end, and in certain embodiments the control mechanism, protrude from an open end of the sleeve. Another individual assembly similarly fits in the sleeve with a dispensing end protruding from the opposite open end of the sleeve. Removable closures are provided to cover the dispensing ends when not in use.

The two applicator assemblies within the sleeve oppose one another in the sleeve, preferably with their bases nearly meeting midway inside the sleeve. In this configuration, the user has access to two separate products in an integrated unit.

Each individual applicator assembly can be secured inside the sleeve by a frictional fit and/or snap fit. The friction fit can be a wall-on-wall friction fit based on the relative inner and outer diameter sizes of the tube and applicator, respectively. Alternatively, the outer sleeve can have one or a series of inwardly projecting ribs extending longitudinally along the sleeve's inner surface that enhance the frictional interaction between the sleeve and the individual applicator assemblies. A further alternative embodiment has the inside mid-portion of the sleeve including inwardly projecting ribs, alone or in combination with a snap-fit structure, to receive and hold a ribbed control knob of an applicator assembly.

A dual pack applicator of the present invention can include roll-on and push-up assemblies and thus can carry in an integrated device a variety of product formats and formulas. For example, a dual pack applicator can provide for variation of similar products, i.e., different shades or flavors of lip balm; or alternatively, provide complementary products, i.e., an insect repellent and a hydrocortisone material for treating bug bites. In the latter case, the ability to have a roll-on and a semi-solid material dispenser allows for use of many combinations of complementary products.

Another advantage provided is the provision of a central outer body area on the applicator suitable for graphics or labeling to provide an appealing aesthetic appearance and/or product labeling.

BRIEF DESCRIPTION OF THE DRAWINGS

The foregoing description, as well as the following detailed description of presently preferred embodiments of the invention, will be better understood when read in conjunction with the appended drawings. For purposes of illustrating the invention, there are shown in the drawings embodiments which are presently preferred. It should be understood, however, that the invention is not limited to the precise arrangements and instrumentalities shown. In the drawings.

DETAILED DESCRIPTION AND PRESENTLY PREFERRED EMBODIMENTS

According to the present invention, an outer sleeve, preferably of a molded or extruded plastic, contains two individual applicator assemblies allowing for separate dispensing from a single applicator.

Figure 6:
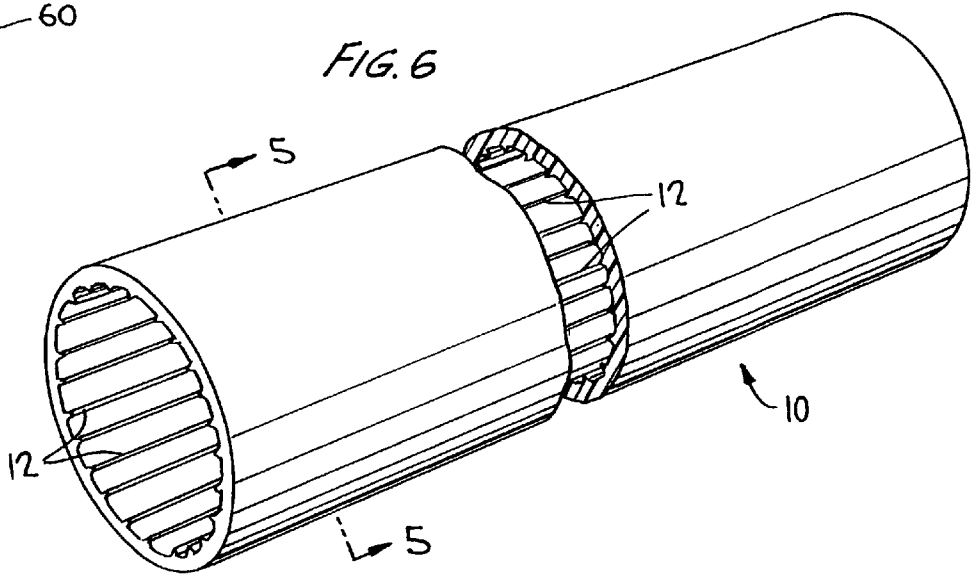
FIG. 6 shows a perspective view in partial cutaway of the outer sleeve of FIG. 5.
Figure 5:
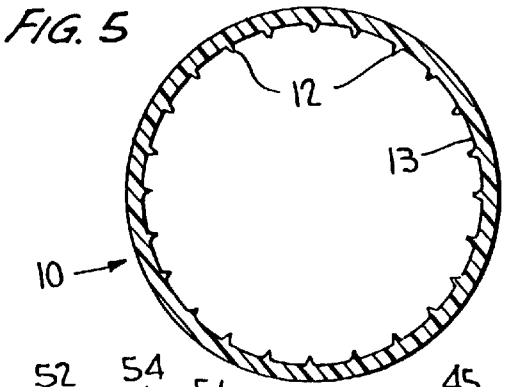
FIG. 5 shows a cross-sectional view along line 5—5 of an outer sleeve according to the present invention as shown in FIG. 6.

Referring to FIGS. 5 and 6, an extruded plastic outer sleeve 10 according to the present invention is shown. Sleeve 10, which is generally tubular and open at each of its two ends, is capable of receiving an applicator assembly through either end.

Inwardly projecting ribs 12 extend from the inner surface 13 of the sleeve and, preferably, extend longitudinally over at least a portion of the sleeve's length. FIG. 6 illustrates an embodiment where the ribs extend across the entire length of the sleeve. When fitted with an applicator assembly, ribs 12 interfere with the applicator exterior to enhance the frictional fit of the applicator in the sleeve. Sleeve 10 as shown in FIGS. 5 and 6 has 24 evenly spaced ribs, however the number of ribs utilized and the spacing thereof can be varied. For example, a lesser number of ribs can be present, either evenly spaced or present in spaced apart groups, e.g., 3 groups of 6 ribs. Further, and as will be apparent to one skilled in the art, the ribs can run the entire length of the sleeve, or can be limited to certain critical regions. Ribs 12 have pointed peaks in order to optimize their frictional hold.

Figure 8:
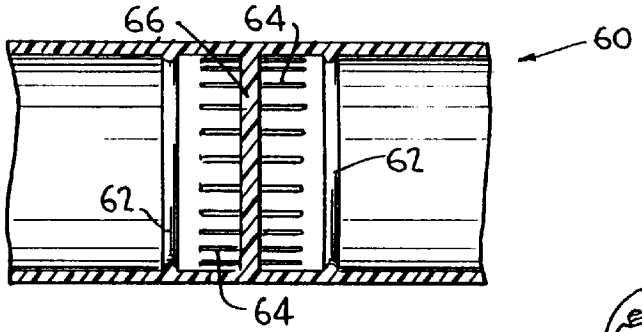
FIG. 8 shows a cross-sectional view of an alternative outer sleeve structure according to the present invention.

Referring to FIG. 8, a second embodiment of the tubular outer sleeve is shown. The inner surface of outer sleeve 60 includes two annular beads 62, two series of ribs 64 and a central transverse wall 66. Ribs 64 cooperate to non-rotatably hold a screw control knob. Beads 62 provide a snap-fit. Outer sleeve 60 is particularly adapted to receive a screw operated push-up applicator in each side, as will be described in greater detail hereafter.

Figure 1:
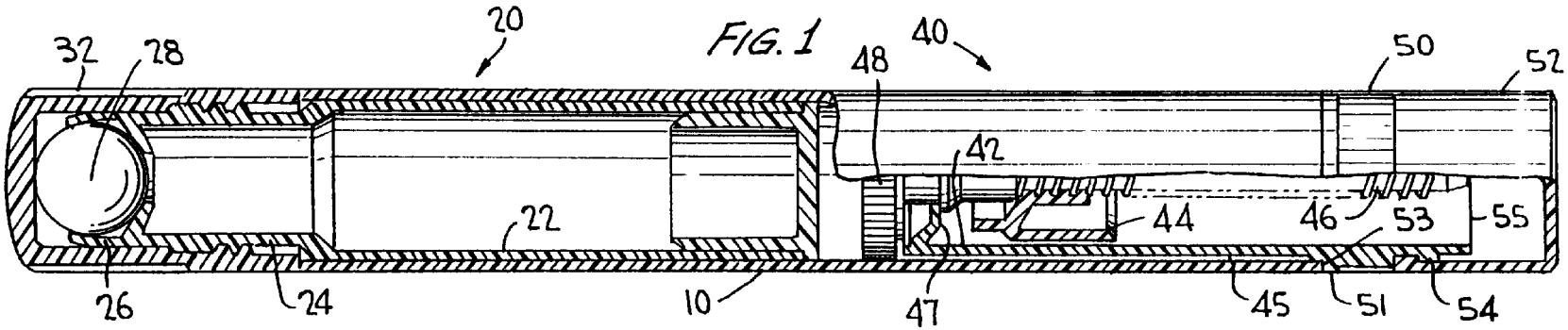
FIG. 1 shows a partial cutaway of a dual pack applicator according to the present invention, including an outer sleeve, a roll-on assembly, a collar turn operated push-up assembly, and removable closures at each end.

Referring now to FIG. 1, a dual pack applicator according to the present invention includes outer sleeve 10 containing a roll-on assembly 20 and collar turn operated assembly 40. Each assembly is inserted and secured in sleeve 10 with its dispensing end protruding from an end of the sleeve.

Roll-on assembly 20 inside sleeve 10 as shown in FIG. 1 includes barrel 22, which can contain a liquid product, externally threaded neck 24 and cup 26 holding ball 28 in rotatable suspension. Barrel 22 has an outer diameter smaller than the inner diameter of sleeve 10. The outer surface of barrel 22 fits snug against ribs 12 (shown in FIG. 5) on outer sleeve 10 to create a frictionally secure fit to hold assembly 20 in a longitudinally and non-rotatably fixed position inside sleeve 10. It is to be understood, however, that roll-on assembly 20 can also be secured inside sleeve 10 in any other suitable manner e.g., by snap fit.

For example, barrel 22 can have a protruding annular bead around its outer surface, which forms a snap fit into an optional annular groove in sleeve 10 to secure roll-on assembly 20 in outer sleeve 10. Alternatively, roll-on assembly 20 can be adequately held in sleeve 10 by a simple friction fit without the aid of internal ribs or bead.

Closure 32 encloses neck 24 and ball 28 when the dispenser is not in use. Preferably, closure 32 is an internally threaded twist off closure as shown in FIG. 1.

Collar turn operated assembly 40 is also secured within outer sleeve 10. Barrel 42 can contain a salve, semi-solid material or the like supported by elevator 44, which is threadably engaged with stationary screw 46. Barrel 42 can rotate within sleeve 10 as controlled by a user by barrel collar 50, abutting the end 53 of sleeve 10. This is based on screw knob 48 being non-rotatably secured inside sleeve 10, allowing relative rotation between barrel 42 and screw 46. Rotation of barrel 42 about stationary screw 46 produces elevator travel and extension of material from the applicator dispensing end 55.

Figure 7:
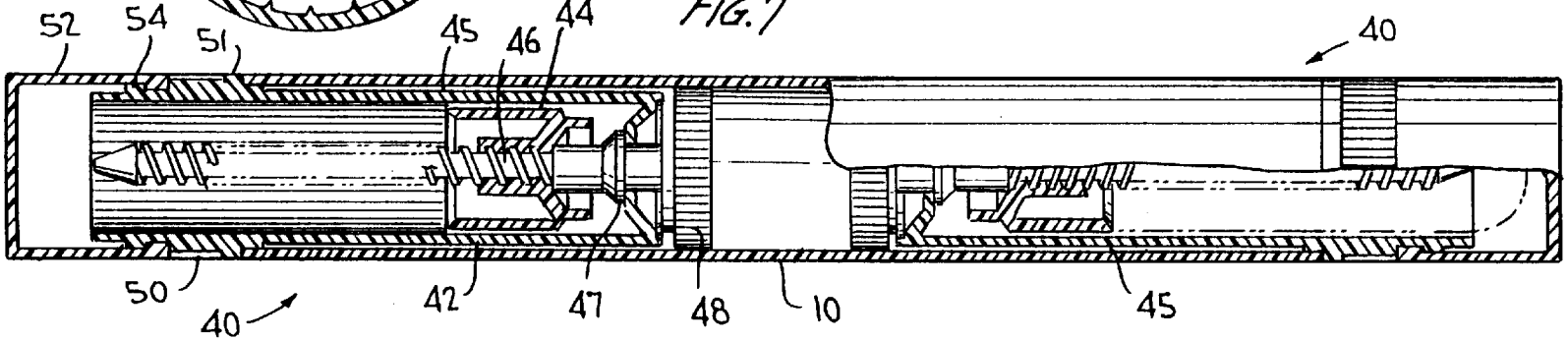
FIG. 7 shows the applicator of FIG. 2 in partial cutaway.

Stationary screw knob 48 is held in place by a frictional interaction with outer sleeve 10. Specifically, knob 48 has external ridges which cooperate with ribs 12 (shown in FIG. 5) or 64 (shown in FIG. 8) to form a secure non-rotatable fit inside sleeve 10. When ribs 12 are used, ribs 12 do not interfere with the rotation of barrel 42, which has a smaller external diameter than knob 48. Thus, as shown in FIGS. 1 and 7, a sufficient space 45 is present between barrel 42 and outer sleeve 10, while screw knob 48 abuts outer sleeve 10, so as to allow rotation of barrel 42 by collar 50. It can therefore be seen, that the ribs function only in the region of the screw knob 48. Accordingly, when differently structured product supply containers are used, such as shown in FIG. 1, ribs projecting the length of outer sleeve 10 as shown in FIG. 6 are useful due to their versatility. However, when two collar turn operated containers are used, as shown in FIG. 7, the embodiment as shown in FIG. 8 is preferred since only friction against knob 48 is required. In this embodiment, the base of screw knob 48 abuts transverse wall 66 and is held in place by the combined action of annular bead 62, preventing longitudinal movement, and ribs 64, preventing rotation of knob 48. Barrel 42 remains free to rotate inside sleeve 60 as described above.

Figure 3:
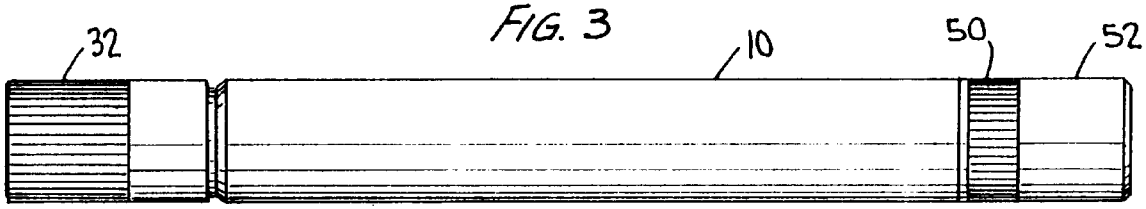
FIG. 3 shows the exterior of the dual pack applicator of FIG. 1.
Figure 2:
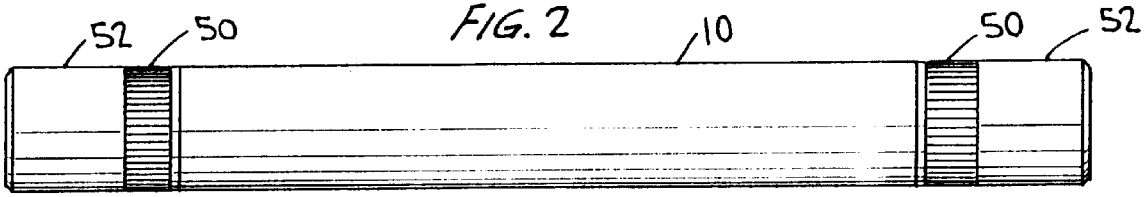
FIG. 2 shows the exterior of a dual pack applicator, containing two opposing collar turn operated push-up assemblies and removable closures at each end.

Attached to barrel 42 is a closure 52, which is preferably a snap closure engaged at annular lip 54 on the barrel 42. FIG. 3 shows the exterior of the dual pack applicator of FIG. 1. FIG. 2 shows the exterior of the applicator of FIG. 7 including two removable closures 52.

Figure 4:
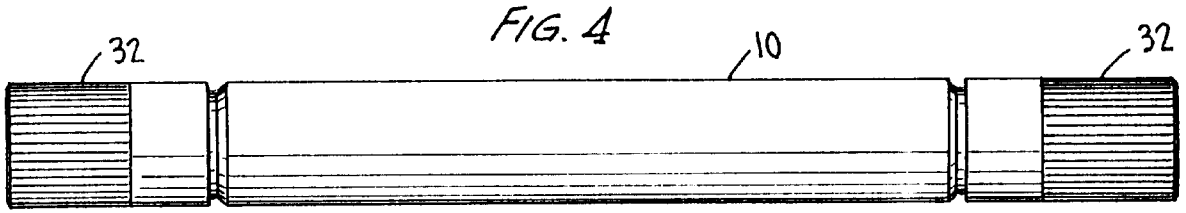
FIG. 4 shows the exterior of a dual pack applicator containing two roll-on assemblies and removable closures at each end.

The embodiments described allow a user access to two product formulas in a single package and can include a useful combination of a collar turn operated assembly and a roll-on. For example, a push-up lip balm can be combined with a roll-on lip gloss. The dual collar turn embodiment of FIG. 7 also allows storage of different formulas in a dual pack unit. As shown in FIG. 4, the invention can also be practiced in an embodiment that contains two opposing roll-on assemblies. It is clear that almost any combination of the outer sleeves and assembly structures described herein can be integrated in a dual pack applicator.

Major advantages of the dual pack applicator of the present invention include its simplicity, low cost, and versatile adaptability to several individual applicator assemblies. These assemblies can be already existing self-sufficient individual applicators. A benefit of this is the economy in using existing assemblies which easily integrate into the dual pack configuration of the present invention.

Suitable individual applicator assemblies for the present invention include pre-existing roll-on and collar turn operated devices (as shown for example in FIGS. 1 and 7), and also a conventional screw operated push-up device that is operated by turning a control knob at the end opposite the dispensing end as opposed to an upper collar.

Another advantage of the dual pack applicator of the invention is its increased body size as compared to conventional single product applicators. The increased exterior body size provides more space for graphics, e.g., a manufacturer's logo(s), product information, and the like.

As will be apparent to one skilled in the art, various modifications can be made within the scope of the preceding description. Such modifications being within the ability of one skilled in the art form a part of the present invention and are embraced by the appended claims.

What is claimed is:

1. A dual pack applicator comprising:

a hollow substantially cylindrical outer sleeve having an inner surface, an outer surface, an open first end, and an open second end; and first and second substantially cylindrical applicator assemblies, each having a base end, a dispensing end, an interior product storage space and an outer diameter less than an inner diameter of said sleeve;

wherein said first and second applicator assemblies are disposed within said outer sleeve such that said dispensing ends protrude from said first end and said second end, respectively, and said first and second applicator assemblies are essentially longitudinally immovable relative to said outer sleeve;

wherein said inner surface of said sleeve has at least one inwardly projecting rib;

wherein at least one of said applicator assemblies comprises a screw-operated push-up assembly including a barrel containing a screw with an external screw knob, said knob being immovably fixed within said outer sleeve, and said barrel being able to rotate in said outer sleeve; and wherein said at least one rib engages said screw knob.

2. The dual pack applicator of claim 1 wherein said at least one rib extends longitudinally along said inner surface.

3. The dual pack applicator of claim 1 further comprising:

a transverse wall in said outer sleeve located approximately midway between said open first end and said open second end, said transverse wall being perpendicular to said inner surface and dividing the interior of said outer sleeve into two compartments.

* * * * *